US006393623B1

(12) United States Patent
Strickland, Jr.

(10) Patent No.: US 6,393,623 B1
(45) Date of Patent: May 28, 2002

(54) TOILET SEAT RAISING AND LOWERING LIFT DEVICE

(76) Inventor: Rufus Willie Strickland, Jr., Post Office Box 555, Conway, SC (US) 29528

( * ) Notice: Subject to any disclaimer, the term of this patent is extended or adjusted under 35 U.S.C. 154(b) by 0 days.

(21) Appl. No.: 09/899,703

(22) Filed: Jul. 5, 2001

(51) Int. Cl.[7] ..... A47K 13/10
(52) U.S. Cl. ..... 4/246.3
(58) Field of Search ..... 4/246.1, 246.2, 4/246.3, 246.4, 246.5

(56) References Cited

U.S. PATENT DOCUMENTS

| | | | | | |
|---|---|---|---|---|---|
| 1,632,819 | A | * | 6/1927 | Chastain | 4/246.5 |
| 1,863,682 | A | * | 6/1932 | Alberts | 4/246.3 |
| 2,088,050 | A | * | 7/1937 | Brown | 4/246.4 |
| 2,705,330 | A | | 4/1955 | Knudsen | 4/246.1 |
| 4,150,446 | A | | 4/1979 | Crocker | 4/246.3 |
| 4,426,743 | A | | 1/1984 | Seabrooke | 4/246.3 |
| 4,470,161 | A | | 9/1984 | Seabrooke | 4/246.3 |
| 5,056,165 | A | | 10/1991 | Wescott, Sr. | 4/249 |
| 5,404,595 | A | | 4/1995 | Carmel | 4/246.1 |
| 5,829,068 | A | | 11/1998 | Smith | 4/246.3 |

* cited by examiner

*Primary Examiner*—Robert M. Fetsuga
(74) *Attorney, Agent, or Firm*—Robert R. Reed

(57) ABSTRACT

The present invention includes a floor mounted toilet with a mechanical lift device comprising an adjustable linkage assembly connected between a foot pedal and a torque arm of a torque rod. The torque rod is affixed to the toilet seat to rotate the toilet seat. Applying a pedal force raises the toilet seat to a raised seat angle. A floor mounted base member rotationally supports the foot pedal and rigidly supports a vertical member carrying a pivot plate of the linkage assembly to rotate about a pivotal axis. The initial force to raise the toilet seat is adjusted by changing the first length of an upper rod of the linkage assembly. The raised seat angle is adjusted by the second length of a lower rod of the linkage assembly. The first and second lengths are adjusted by providing length adjusting devices, such as a turnbuckle.

20 Claims, 7 Drawing Sheets

10
16
14
12a
12
40
42
30
31
34
B
32
31a
18
25a
A
25
24
22
23
20
21
21a

TOILET SEAT RAISING AND LOWERING LIFT DEVICE

BACKGROUND OF THE INVENTION

This invention is directed to a device or assembly for raising and lowering a toilet seat. In particular the lift device includes a foot pedal and linkage assembly that can be adjusted to provide increased lifting forces and control the angle of the raised toilet seat.

A long time problem with toilets exists with the different ways the toilet seat is used by males when compared with female users. The toilet seat in one case is kept in a horizontal position resting on the toilet bowl and in the other case the seat is rotated about a hinge connecting the rear edge of the toilet seat with the toilet bowl. Many persons dislike touching the toilet seat with their hands, particularly in public toilets. The touching of the seat also results in a definite hygiene problem. As a result of this personal dislike, as well as the hygiene problem, numerous devices for raising the toilet seat without a person using their hands been provided heretofore. The prior devices have not come into very wide use, primarily because they were cumbersome, difficult and expensive to install and difficult to maintain and clean.

A number of solutions to the seat lifting problem disclose a foot activated devices where a pedal is displaced that rotates the seat by way of a connecting assembly from the pedal to the toilet seat. Typical patents that disclose a foot pedal with a connecting cable are U.S. Pat. Nos. 4,150,446; 4,470,161; and 5,829,068. The '446 patent includes a floor mounted foot pedal connected to a cable passing through a pulley and extends to an angle bracket which raises the seat. A set screw at the end of the cable adjusts the tension in the cable. In the '161 patent resilient absorbing devices (springs) are added at the foot-operated petal and the control lever at the seat assembly to provide seat-rasing torque and shock absorbing forces. In the '068 patent a cable is provided on each side of the toilet bowl and each cable is placed within and guided by an L-shaped member between the upper and lower couplers. These patents do not disclose a means for adjusting the connecting assemblies or the length of the cable to independently control the lifting force provided by the cable for raising the seat and the angle of the seat with respect to the toilet bowl.

Other solutions to the seat lifting problem disclose a foot activated devices where a pedal is displaced that rotates the seat by way of a connecting assembly of rods or shafts between the foot device and the seat hinges. The U.S. Pat. No. 5,056,165 discloses a system of shafts interconnected by shaft flanges within conduits that rotate or translate when a seat lift pedal is depressed and the first shaft is rotated to effect a lifting of the toilet seat. The U.S. Pat. No. 5,404,595 discloses a pedal movable about a base and connected to a rod. The rod is connected to the a power transferring means at the toilet seat to rotate the toilet seat. Once again, these patents do not allow for adjustments in the length of the rods and shafts for the purpose of easily controlling the torque on the toilet seat and the toilet seat angle with respect to the toilet bowl.

A further problem exists in providing enough torque to the toilet seat to start raising the seat but less torque when the seat has been raised. The control of the torque on the toilet seat hinges is desirable for smooth operation of raising and lowering the toilet seat. Various devices are provided in the art for assisting the user in applying a torque to the toilet seat when raising the seat by a foot pedal device. Typical patents providing the added torque in lifting the seat include U.S. Pat. Nos. 2,705,330 and 4,426,743. In the '330 patent a gear housing containing a gear train is mounted on an offset bracket attached to the toilet bowl. The gears provide a mechanical advantage when the foot lever is depressed. In '743 the toilet seat is equipped with a helical spring to increase or bias the force or torque for raising the seat. This patent also uses a cable arrangement between the foot pedal and the fitting, having a crank element therein. These patents include components (i.e. gears and cranks) which are expensive to make and difficult to clean.

The need remains for a toilet seat raising and lowering lift device which can be easily and efficiently manufactured to be durable and reliable device for installation on a wide variety of makes and models of domestic and commercial toilets. The lift device should be adjustable to both control the lifting torque on the toilet seat and the toilet seat angle with respect to the toilet bowl. A further need is to provide an lift device which does not interfere with normal manual operation of the toilet seat for persons not familiar with the device.

Accordingly, an object of the present invention is to provide a toilet seat raising and lowering lift device which has the advantages of the art and overcomes some of the disadvantages normally associated therewith by solving the remaining needs previously discussed.

Another object of the present invention is to provide a foot activated toilet seat for raising and lowering lift device with a linkage assembly that has dual adjustment means for (1) optimizing the lifting torque on the toilet seat and (2) setting the desired angle of the lifted seat relative to the toilet bowl.

A further object of the present invention is to provide an lift device which can be efficiently manufactured to be durable and reliable for installation on a wide variety of makes and models of toilets without the need for special parts.

Still another object of the present invention is to provide a toilet seat raising and lowering lift device which allows the user to avoid unsanitary contact with the toilet seat minimizing transmittal of various viral and bacteriological diseases.

SUMMARY OF THE INVENTION

The above objectives are accomplished according to the present invention by providing a floor mounted toilet with a mechanical lift device comprising an adjustable linkage assembly connected between a foot pedal and a torque arm of a torque rod. The torque rod is affixed to a seat bracket of the toilet seat so that rotating the torque rod about a seat axis, by applying a pedal force on the foot pedal, raises and lowers the toilet seat to a raised seat angle above the toilet bowl. A base member mounted to the floor rationally supports the foot pedal and rigidly supports a vertical member having an upper end for carrying a pivot plate of the linkage assembly to rotate about a pivot pin defining a pivotal axis. The initial force to raise the toilet seat is provided by adjusted the first length of an upper rod of the linkage assembly. A predetermined raised seat angle is selected by adjusting the second length of a lower rod of the linkage assembly. The first and second lengths are adjusted by providing length adjusting devices, such as a turnbuckle.

In one embodiment of the invention a mechanical lift device is provided for raising and lowering a toilet seat of a toilet bowl mounted on a floor. The lift device comprises the following components and functional features. A torque arm and torque rod are attached to the toilet seat for raising and lowering the toilet seat when the torque rod is rotated by displacing the torque arm. A horizontal base member supports a vertical member having upper and lower ends. The base member is affixed to the floor and supports the vertical member at the lower end of the vertical member. A foot pedal having first and second ends is pivotally mounted to the base member at the first end and the foot pedal has a top surface accessible for the user to apply a pedal force. A linkage assembly, including a lower rod having a first adjustable length, a pivot plate pivotally carried at the upper end of the vertical member and an upper rod having a second adjustable length is connected between the second end of the foot pedal and the free end of the torque arm. Applying a pedal force to the top surface of the foot pedal lifts the toilet seat to a raised seat angle with respect to the toilet bowl and removing the pedal force lowers the toilet seat with respect to the toilet bowl.

One aspect of the lift device includes connecting one end of the upper rod to the torque arm and the other end of the upper rod to the pivot plate. The first adjustable length of the upper rod adjusts a torque arm force to lift the toilet seat when an axial force is initially applied to the upper rod by rotating the pivot plate. A further aspect of the lift device includes connecting one end of the lower rod to the second end of the foot pedal and the other end to the pivot plate. Therefore, when the foot pedal is rotated about a base axis of the base member by applying the pedal force to the top surface of the foot pedal, an axial force is applied to the lower rod to rotate the pivot plate. The second length of the lower rod is adjustable to provide a predetermined raised seat angle of the toilet seat relative to the toiled bowl when the foot pedal is fully depressed.

In another embodiment of the invention, a lifting and lowering assembly is provided in combination with a toilet. The combination includes a toilet seat having a pair of seat brackets for mounting said toilet seat on a toilet bowl of the toilet for rotational movement of said toilet seat about a seat axis. A torque arm and rod is affixed to the seat brackets to rotate the toilet seat when a torque arm force is applied to a free end of the torque arm. A horizontal base member supports a vertical member having upper and lower ends. The base member is mounted on the floor adjacent to the toilet bowl to support the vertical member at its lower end. A foot pedal is provided having first and second ends. The first end is rotatably mounted to the base member. A linkage assembly is provided to include a lower adjustable length rod, a pivot plate carried by said upper end of said vertical member and an upper adjustable length rod. The linkage assembly is connected between the second end of the foot pedal and the free end of the torque arm so that applying a pedal force, to rotate the foot pedal about its first end, lifts the toilet seat. Removing the pedal force lowers the seat to rest on the toilet bowl.

A further embodiment of the invention comprises a method for raising and lowering a toilet seat of a floor mounted toilet bowl of a toilet. The method includes the following steps:

a) provide a torque rod attached to the toilet seat and a torque arm for applying a predetermined torque arm force to the torque arm;

b) connect one end of a linkage assembly to the torque arm, wherein the linkage assembly has a pivot plate, an upper rod and a lower rod;

c) rotatably mount the pivot plate to an upper end of a vertical member supported by a base member mounted on the floor;

d) connect the other end of the linkage assembly to a foot pedal rotatably carried by the base member;

e) adjust a first length of the linkage assembly, being the length of the upper rod, to provide the predetermined torque arm force for initially raising the toilet seat;

f) apply a pedal force to the foot pedal to fully depress the foot pedal and lift the toilet seat to a raised seat angle with respect to the toilet bowl;

g) adjust a second length of the linkage assembly, being the length of the lower rod, to provide a predetermined seat angle less than 90 degrees;

h) remove the pedal force and lower the seat to rest on the toilet bowl; and i) repeat steps f) and h) to repeatedly raise and lower the toilet seat.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
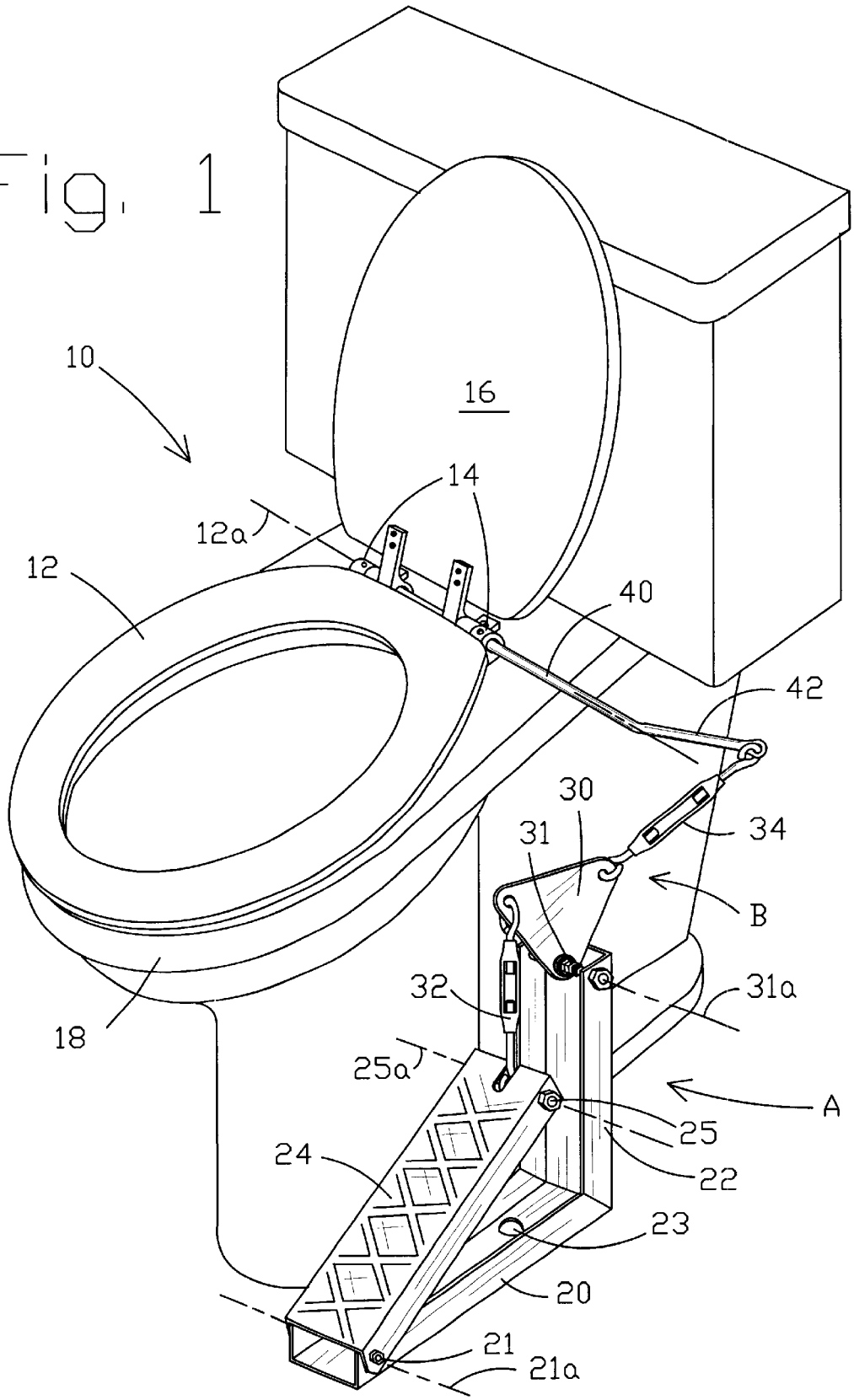
FIG. 1 is a perspective view of a typical toilet having toilet seat with a mechanical lift device for raising and lowering the toilet seat to include a torque rod and arm affixed to seat brackets of the toilet seat which is activated by a foot pedal connected to the torque arm through a linkage assembly supported by a vertical member.

Referring now in more detail to the drawings, the invention will now be described in more detail. The mechanical assembly of this invention provides a lift device for raising and lowering a toilet seat of a conventional floor mounted toilet 10, as illustrated in FIG. 1. The lift device A is operated by applying a pedal force to a foot pedal 24 which is connected by a base pin 21, defining a base axis 21*a,* to a horizontal base member 20 affixed to the floor by fasteners 23. The foot pedal is connected by a linkage assembly B to a torque arm 42 of a torque rod 40. The torque rod is affixed to seat brackets 14 of the toilet seat 12. The seat brackets are affixed to a toilet bowl 18 mounted on the floor. When a torque is applied to the torque rod by the torque arm, the torque rod rotates about seat axis 12*a* raising the toilet seat. Normally a lid 16 has already been lifted by rotated the lid about the seat axis. However, lift device A can be made to lift both the lid and the toilet seat within the scope of this invention.

The linkage assembly is adjustable and comprises a pivot plate 30, a lower rod 32 and an upper rod 34. The pivot plate is supported at the upper end of a vertical member 22, which is rigidly supported by base member 20. The pivot plate is pivotally attached to the vertical member by a pivot pin 31 to rotate in a vertical plane about a pivotal axis 31*a.* The upper rod has a first adjustable length and is connected between the torque arm and the pivot plate. The lower rod has a second adjustable length and is connected between the pivot plate and the foot pedal. The lower rod is connected to the foot pedal by a pedal pin 25 defining a pedal axis 25*a.*

When foot pedal 24 is rotated about base axis 21*a,* the pedal pin applies an axial load in lower rod 32 which forces pivot plate 30 to rotate about pivotal axis 31*a.* This rotation of the pivot plate places an axial load in upper rod 34 which applies a torque arm force on the end of torque arm 42 to rotate torque rod 40 and lift toilet seat 12. When the pedal force is removed the toilet seat is lowered to rest on toilet bowl 18. Both the upper and lower rods are adjustable in length to provide two degrees of freedom in adjusting lift device A to fit the size of toilet 10 and to operate in a predetermined optimum manner. These two unique adjusting features will be discussed in more detail in the following sections of this description. In addition, the lift device or this invention can be floor mounted on either side of the toilet bowl as desired.

Figure 2:
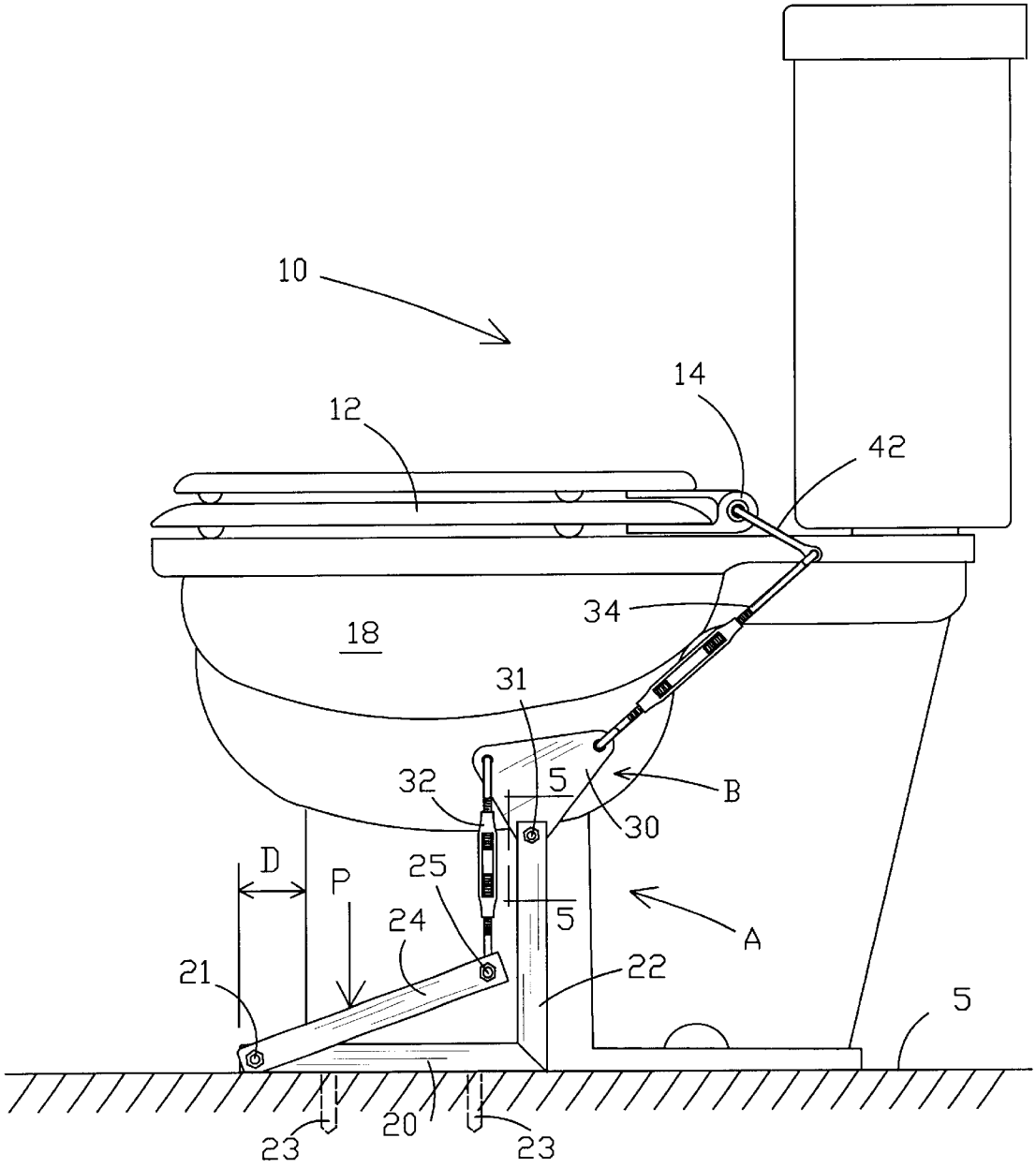
FIG. 2 is a side elevation view of the toilet and lift device illustrating a relative geometric position of the components of the lift device relative to the toilet for raising the toilet seat when a pedal force is applied.
Figure 2A:
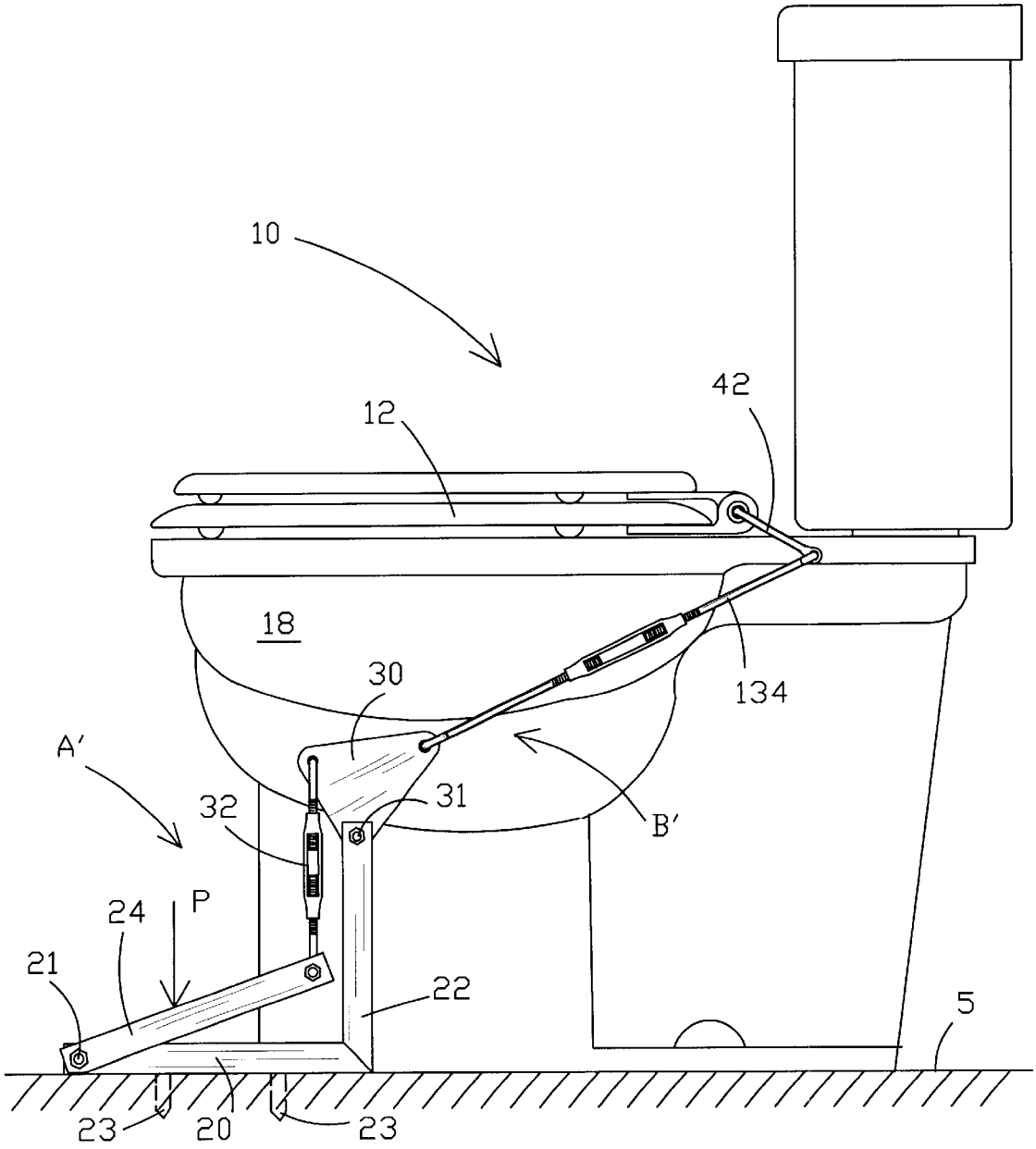
FIG. 2A is a side elevation view of the toilet and lift device illustrating another geometric position of the components of the lift device relative to the toilet of FIG. 2 when the lift device is moved forward to become more accessible to a user.

Side elevation views of lift device A are shown in FIGS. 2 and 2A to illustrate the location of the lift device relative to the location of toilet 10. Depending on the desired location of the feet of a person using the toilet one may have a preferred location for placing the lift device on a floor 5. The location illustrated in FIG. 2 is considered to be the most desirable location for someone setting on the toilet seat. The location illustrated in FIG. 2A is considered to be the most desirable for someone standing up to use the toilet. The preferred location is usually a compromise between these two locations. The present invention allows for a minor change in the lift device to accommodate any desired floor location.

Lift device A of FIG. 2 is mounted on floor 5 using fasteners 23 to affix base 20 to the floor. The lift device is located a distance D in front of toilet bowl 18. Once again, vertical member 22 supports pivot plate 30 of linkage assembly B and lower rod 32 connects foot pedal 24 with the pivot plate. Upper rod 34 has a first length to reach from the free end of torque arm 42 to the pivot plate. Toilet seat 12 is lifted by applying pedal force P to the foot pedal to rotate the seat brackets 14 and raise the toilet seat. The first length of the upper rod is adjusted to optimize the ability to lift the toilet seat.

Lift device A' of FIG. 2A is essentially the same as that of FIG. 2 described above, except an upper rod 134 is provided having a first adjustable length longer than upper rod 34 (FIG. 2). This longer upper rod allows the lift device to be located a distance D' in front of the toilet bowl. Lift device A' operates the same as lift device A and the first adjustable length of rod 134 also adjusts to optimize the ability to lift the toilet seat.

Figure 3:
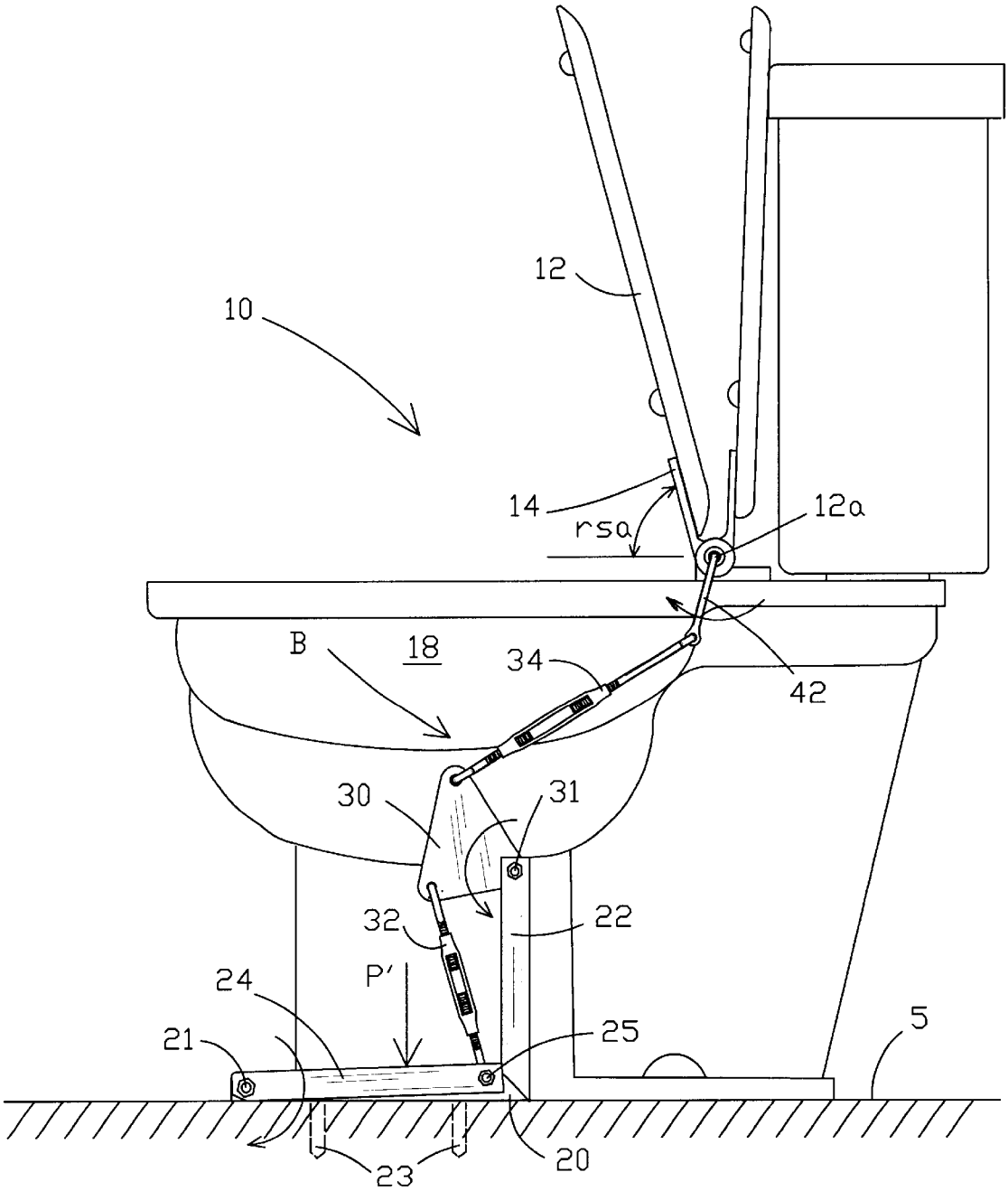
FIG. 3 is a side elevation view of the toilet and lift device illustrating a relative geometric position of the components of the lift device relative to the toilet when the toilet seat has been lifted to a predetermined angle with respect to the toilet bowl by applying the pedal force.

Having raised the toilet seat by continuously applying a pedal force, the toilet seat illustrated in FIG. 2 reaches a predetermined raised seat angle "rsa", as illustrated in FIG. 3. A pedal force P', less than the initial pedal force P, is adequate to maintain toilet seat 12 in a raised position. In reaching the raised position the foot pedal has rotated about base pin 21 at base member 20, pivot plate 30 has rotated about pivotal pin 31 at the upper end of vertical member 22 and seat brackets 14 have rotated the toilet seat by rotating the torque arm 42 with respect to a seat axis 12*a;* as shown by the curved arrows in each case. Once again, base member 20 is affixed to floor 5 by fasteners 23 to rigidly support vertical member 22 and rotationally support foot pedal 24. The linkage assembly B has assumed a new position consistent with the depressed position of the foot pedal and the rotation of the torque arm. The raised seat angle of the toilet seat with respect to toilet bowl 18 can now be adjusted to provide a desired raised seat angle by adjusting the second adjustable length of lower rod 32. A raised seat angle less than 90 degrees is provided so that, when the pedal force is removed, the toilet seat lowers itself to rest on the toilet bowl. A preferred raised seat angle is about 75 degrees. The first adjustable length of upper rod 34 is not changed during the raised seat angle adjustment. See the discussion of FIG. 7 in the following sections for a detailed explanation of this angle adjustment.

Figure 4A:
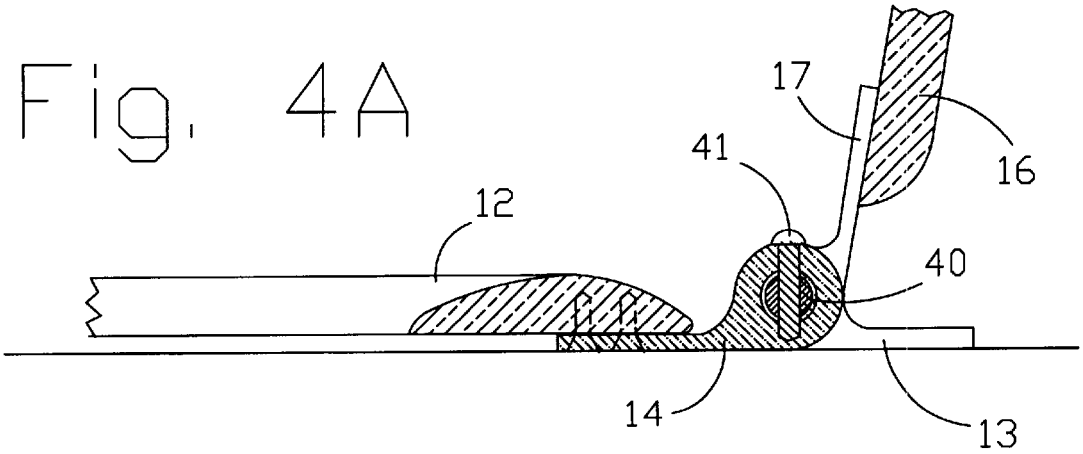
FIG. 4A is a cross-sectional view of the toilet seat and lid taken along line 4A—4A in FIG. 4 showing the pin connector device extending through the seat bracket and torque rod so that the toilet seat is lifted when the torque rod is rotated.
Figure 4:
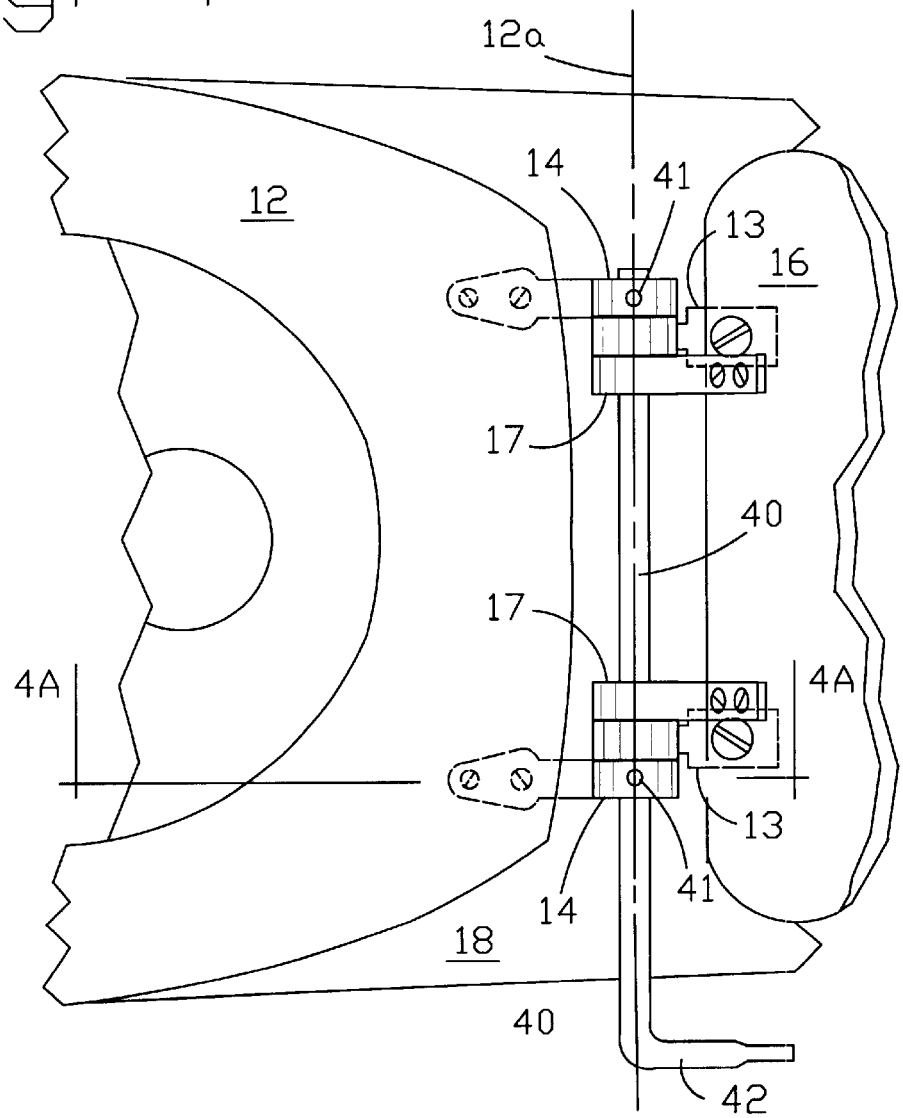
FIG. 4 is a plan view of the toilet seat and lid resting on the toilet bowl with a torque rod connected to seat brackets of the toilet seat using a pin connector device for raising the toilet seat when a torque is applied to the torque rod by a torque arm.

Referring to the plan view of FIG. 4 and the cross-sectional view of 4A, a detailed description of how the torque rod raises the toilet seat is provided. Having raised lid 16, toilet seat 12 is in a position to be rotated about seat axis 12*a.* Toilet seat 12 and lid 16 are conventionally supported by a pair of seat attachment elements 13 affixed to toilet bowl 18. Each attachment element has a short rod that carries a seat bracket 14 of the toilet seat and a lid bracket 17 of the lid; so that the toilet seat and the lid can be rotated about the seat axis. In the present invention the short rod has been removed and a long torque rod has been added to basically perform the same function as the short rods. However, the seat bracket is affixed to the torque rod by a pin connector device 41, as illustrated in the cross-sectional view of FIG. 4A taken along line 4A—4A in FIG. 4. As the torque rod is rotated about the seat axis by displacing torque arm 42, the seat brackets also rotate about the seat axis to force the toilet seat to be raised from the toilet bowl. Other means for physically connecting the torque rod to the seat brackets can be provided within the scope of this invention and as suggested by the referenced art. The invention only requires the seat to be raised and lowered consistent with the rotations of the torque rod provided for the lift device.

Figure 5:
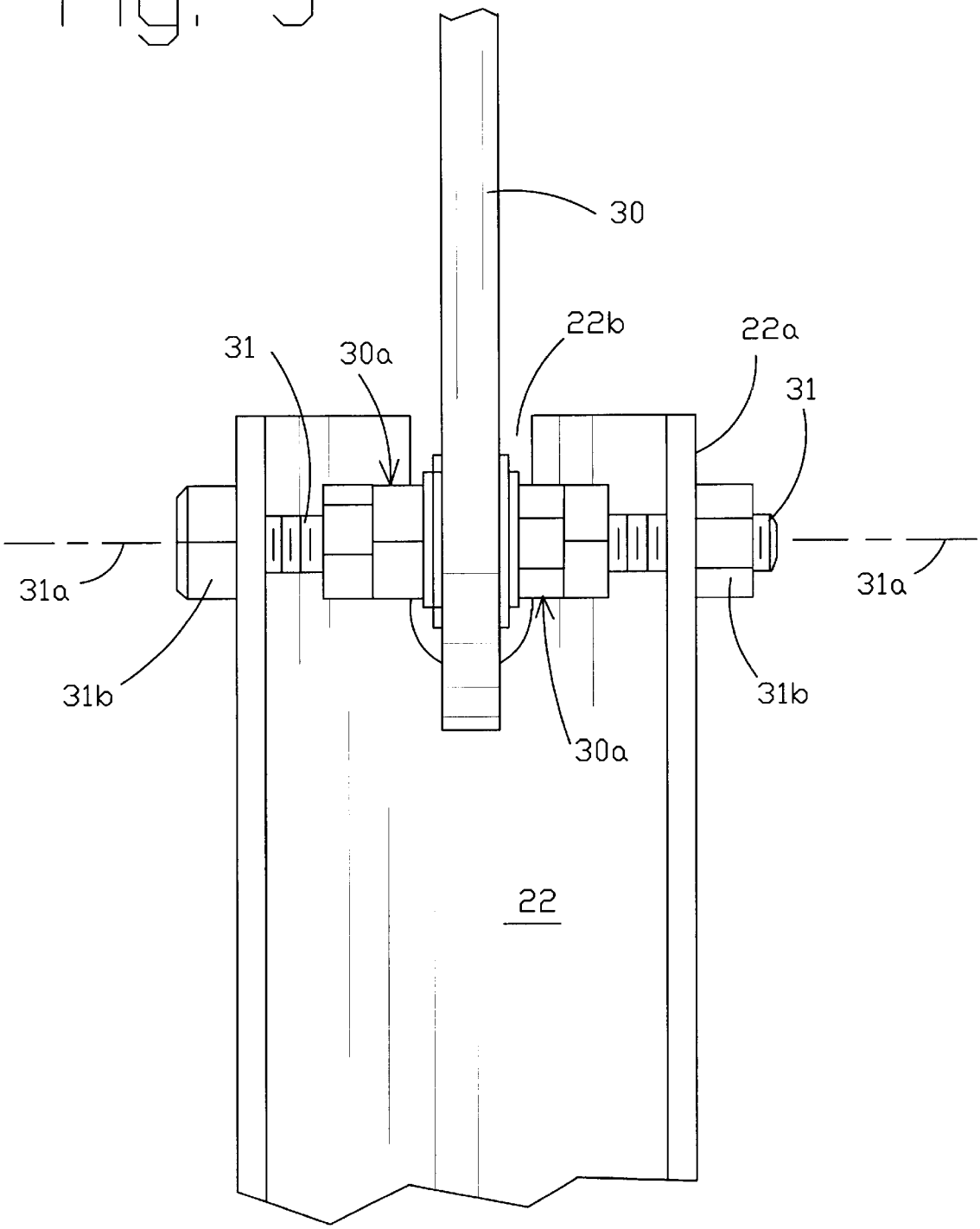
FIG. 5 is an elevation view of the upper end of the vertical member supporting the lower portion of the pivot plate by a pivot pin with stabilizing elements for maintaining rotation of the pivot plate in a vertical plane about a pivotal axis.

Referring to the elevation view of FIG. 5, a detailed description of how the pivot plate is supported by the vertical member is provided. A threaded pivot pin or bolt 31 extends through the flanges at the upper end 22*a* of vertical member 22. The pivot pin defines pivotal axis 31*a* about which pivot plate 30 rotates in a vertical plane. The pivot pin includes end connectors or nuts 31*b* to hold the pivot pin connected to the vertical member. Plate stabilizer elements 30*a* help support the pivot plate in a vertical plane. Typical stabilizer elements include washers and double nuts for holding the pivot plate in a vertical plane and for allowing the pivot plate to freely rotate about the pivotal axis. Alternately. the pivot pin may be affixed to the pivot plate and rotation occurs between the pivot pin and the vertical member. The essential function of the pivot plate supporting means is to keep the pivot plate stable during its rotations. A cutout 22*b* in the vertical member may be required to allow the pivot plate to rotate through a large angle as the linkage assembly operates for raising and lowering the toilet seat.

Figures 6, 7:
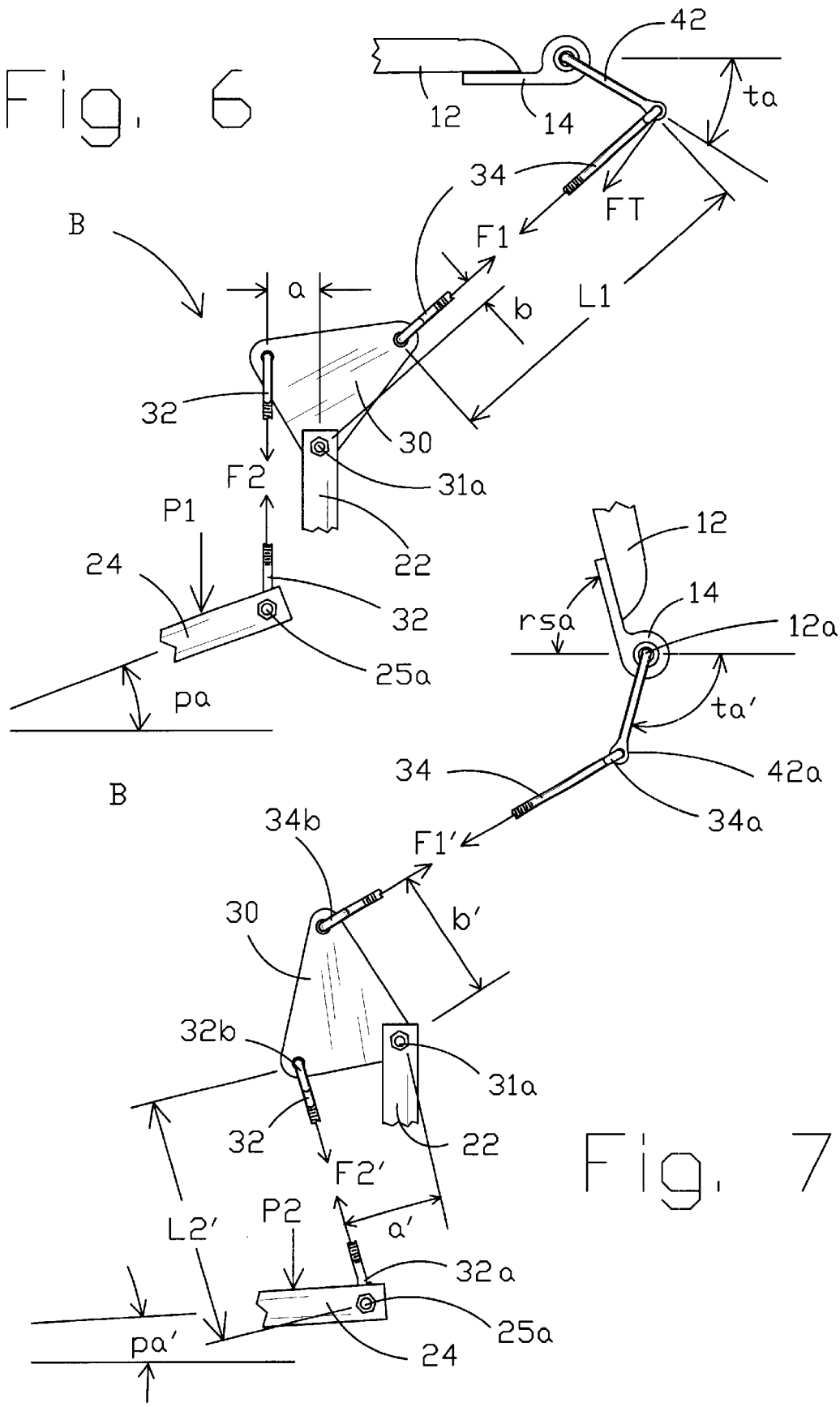
FIG. 6 is a schematic view of the linkage assembly showing the forces and adjustable lengths and angles of the upper and lower rods as well as forces and angles of the foot pedal and the torque arm when the toilet seat is initially being lifted.
FIG. 7 is a schematic view of the linkage assembly showing the forces and adjustable lengths and angles of the upper and lower rods as well as forces and angles of the foot pedal and the torque arm when the toilet seat has been lifted to a predetermined angle.

To illustrate the features of the lift device in more detail, the geometry of the lift device is described in more detail. The relative location of the components of the lift device are schematically illustrated in FIGS. 6 and 7. Important forces, lengths and angles are shown to demonstrate the adjustment features of the linkage assembly B as it relates to toilet seat 12, foot pedal 24 and vertical member 22.

The geometry of FIG. 6 illustrates the lift device when an initial pedal force P1 is applied to start raising the toilet seat. The relationship between the axial force F1 of the upper rod 34 in relation to the axial force F2 of the lower rod is important in providing a torque arm force FT for raising the toilet seat. A seat angle "sa" and torque arm length should also be provided so that axial force F1 is generally along the same line as torque arm force FT. A mechanical advantage can be provided by the geometry of the pivot plate. Pivot plate 30 is supported by vertical member 22 to rotate about pivotal axis 31*a*. This mechanical advantage is quantified by balancing the moments around the pivotal axis. That is, axial force F1 of the upper rod times the offset distance "b" equals axial force F2 of the lower rod times the offset distance "a", or $F1 \times b = F2 \times a$. This equation can be written as $F1 = F2 \times a/b$. Therefore, a mechanical advantage is realized by adjusting a first length L1 of the upper rod to initially rotate the pivot plate so that the ratio of "a" to "b" is larger than one, and is preferably an optimum value for raising the toilet seat. From the position illustrate in FIG. 6, when first length L1 is increased, ratio a/b is decreased and when the first length is decreased the ratio is increased. The limiting value is when distance "b" approaches zero, as the linkage assembly will not operate as desired. Experience gained with a particular toilet and toilet seat will allow the adjustment of first length L1 to provide a desired or predetermined value for the ratio.

The geometry of FIG. 7 illustrates the lift device when foot pedal 24 is fully depressed, with a pedal force P2, and toilet seat 12 has been rotated by the seat bracket 14 to a rotated seat angle "rsa". As the toilet seat is raised the force F1' necessary to keep the toilet seat in a raised position becomes less, and the ratio a'/b' can be reduced, as observed in FIG. 7. In the raised position the rotated seat angle can be established by setting a second length L2 of lower rod 32. A rotated seat angle value is selected less than 90 degrees so that the toilet seat is lowered by reducing and removing pedal force P2.

The unique adjustments of the two rods of the linkage assembly of this invention allow the lift device to have an optimum predetermined operation in solving the problems associated with prior art devices.

While a preferred embodiment of the invention has been described using specific terms, such description is for illustrative purposes only, and it is to be understood that changes and variations may be made without departing from the spirit or scope of the following claims.

What is claimed is:

1. A mechanical lift device for raising and lowering a toilet seat of a toilet bowl mounted on a floor comprising:

a torque arm and torque rod attached to the toilet seat for raising and lowering the toilet seat when said torque rod is rotated by displacing said torque arm;

a horizontal base member supporting a vertical member having upper and lower ends, wherein said base member is affixed to the floor and supports said vertical member at said lower end of said vertical member;

a foot pedal having first and second ends, wherein said foot pedal is pivotally mounted to said base member at said first end and wherein said foot pedal has a top surface accessible for applying a pedal force;

a linkage assembly including a lower rod having a first adjustable length, a pivot plate pivotally carried at said upper end of said vertical member and an upper rod having a second adjustable length, wherein said linkage assembly is connected between said second end of said foot pedal and said free end of said torque arm so that applying a pedal force to said top surface of said foot pedal lifts the toilet seat to a raised seat angle with respect to the toilet bowl and removing said pedal force lowers the toilet seat with respect to the toilet bowl.

2. The lift device of claim 1 wherein said pivot plate includes a pivot pin defining a pivotal axis for pivotally mounting said pivot plate to said upper end of said vertical member so that said pivot plate is free to rotate in a vertical plane bout said pivotal axis.

3. The lift device of claim 1 wherein said upper rod is connected at one end to said torque arm and at the other end to said pivot plate, wherein said first adjustable length of the upper rod is adjusted to provide a torque arm force adequate to lift the toilet seat when an axial force is initially applied to the upper rod by rotating said pivot plate.

4. The lift device of claim 3 wherein said upper rod includes an eyelet at each end for connecting to an opening in said pivot plate at one eyelet end and an opening in said free end of said torque arm at the other eyelet end.

5. The lift device of claim 4 wherein said upper rod includes a length adjusting device, such as a turnbuckle, for adjusting said first length of said upper rod.

6. The lift device of claim 1 wherein said lower rod is connected at one end to said second end of said foot pedal and at the other end to said pivot plate so that, when said foot pedal is rotated about a base axis of said base member by applying said pedal force to said top surface of said foot pedal, an axial force is applied to said lower rod to rotate said pivot plate, wherein said second length of said lower rod is adjustable to provide a predetermined raised seat angle of the toilet seat relative to the toiled bowl when said foot pedal is fully depressed.

7. The lift device of claim 6 wherein said lower rod includes an eyelet at each end for connecting to an opening in said pivot plate at one eyelet end and receiving a pedal pin defining a pedal axis of the foot pedal at the other eyelet end.

8. The lift device of claim 7 wherein said lower rod includes a length adjusting device, such as a turnbuckle, for adjusting said second adjustable length of said lower rod.

9. The lift device of claim 1 wherein said torque arm includes a pin connector for connecting said torque rod to said toilet seat so that rotation of the torque rod by applying said pedal force on said foot pedal rotates the toilet seat to said predetermined angle established by adjusting said first and second lengths of said linkage assembly.

10. The combination assembly of claim 1 wherein said upper adjustable length rod having a first length is connected between said pivot plate and said torque arm so that adjusting the first length establishes the desired initial torque arm force applied to said torque arm through said linkage assembly.

11. The combination assembly of claim 10 wherein said upper adjustable length rod includes an eyelet at each end, for connecting said upper rod to respective openings in said pivot plate and said torque arm, and a turnbuckle for adjusting said first length of said upper rod.

12. In combination with a floor mounted toilet, a raising and lowering lift device comprising:

a toilet seat having a pair of seat brackets for mounting said toilet seat on a toilet bowl of the toilet for rotational movement of said toilet seat about a seat axis;

a torque arm and rod affixed to said seat brackets to rotate said toilet seat when a torque arm force is applied to a free end of said torque arm;

a horizontal base member supporting a vertical member having upper and lower ends, said base member is mounted on the floor adjacent to said toilet bowl and supports said vertical member at said lower end;

a foot pedal having first and second ends, wherein said first end is rotatably mounted to said base member; and a linkage assembly including a lower adjustable length rod, a pivot late carried by said upper end of said vertical member and an upper adjustable length rod, wherein said linkage assembly is connected between said second end of said foot pedal and said free end of said torque arm so that applying a pedal force, to rotate said foot pedal about said first end, lifts said toilet seat and removing said pedal force lowers the seat to rest on said toilet bowl.

13. The combination assembly of claim 12 wherein said lower adjustable length rod has a second length to extend between said foot pedal and said pivot plate so that adjusting said second length establishes a desired angle of said toilet seat with respect to said toilet bowl of about seventy five (75) degrees when said foot pedal is fully depressed.

14. The combination assembly of claim 13 wherein said lower adjustable rod includes an eyelet at one end for connecting to another opening in said pivot plate, an eyelet at the other end for connecting to said foot pedal and a turnbuckle for adjusting said second length of said lower rod.

15. The combination assembly of claim 12 including a pin connector device to affix said torque rod to said seat brackets of said toilet seat so that applying said pedal force on said foot pedal rotates said toilet seat to a predetermined angle from said toilet bowl when said foot pedal is fully depressed.

16. A method for raising and lowering a toilet seat of a floor mounted toilet bowl of a toilet including the steps of:

a) providing a torque rod attached to the toilet seat and providing a torque arm for applying a predetermined torque arm force to said torque arm;

b) connecting one end of a linkage assembly to said torque arm, said linkage assembly having a pivot plate an upper rod and a lower rod;

c) rotatably mounting said pivot plate to an upper end of a vertical member supported by a base member mounted on the floor;

d) connecting the other end of said linkage assembly to a foot pedal rotatably carried by said base member;

e) adjusting a first length of said linkage assembly, being the length of the upper rod, to provide said predetermined torque arm force for initially raising said toilet seat;

f) applying a pedal force to said foot pedal to fully depress the foot pedal and lift the toilet seat to a raised seat angle with respect to the toilet bowl;

g) adjusting a second length of said linkage assembly, being the length of the lower rod, for providing a predetermined raised seat angle less than 90 degrees;

h) removing said pedal force and lowering the seat to rest on the toilet bowl; and i) repeating steps f) and h) for repeated raising and lowering of the toilet seat.

17. The method of claim 16 including the steps of providing a pivot pin for rotatably connecting said pivot plate to said upper end of said vertical member, providing a base pin for connecting said foot pedal to said base member and providing a pedal pin for connecting said lower rod to said foot pedal.

18. The method of claim 16 including the steps of providing eyelets at both ends of said upper rod for connecting to respective openings in said torque arm and said pivot plate and providing eyelets at both ends of said lower rod for connecting one eyelet of said lower rod to another opening in said pivot plate and for the other eyelet to receive the pedal pin of the foot pedal.

19. The method of claim 18 including the steps of providing a first length adjusting device for adjusting said first length of said upper rod and a second length adjusting device for adjusting said second length of said lower rod.

20. The method of claim 16 wherein the step of adjusting said second length of said linkage assembly includes setting said raised seat angle at about seventy five (75) degrees.

* * * * *